US006962207B2

(12) United States Patent
Sundholm

(10) Patent No.: US 6,962,207 B2
(45) Date of Patent: Nov. 8, 2005

(54) FIRE FIGHTING APPARATUS

(76) Inventor: Göran Sundholm, Ilmari Kiannon kuja 3, FIN-04310 Tuusula (FI)

( * ) Notice: Subject to any disclaimer, the term of this patent is extended or adjusted under 35 U.S.C. 154(b) by 405 days.

(21) Appl. No.: 09/297,256

(22) PCT Filed: Sep. 11, 1998

(86) PCT No.: PCT/FI98/00712

§ 371 (c)(1),
(2), (4) Date: Apr. 28, 1999

(87) PCT Pub. No.: WO99/13949

PCT Pub. Date: Mar. 25, 1999

(65) Prior Publication Data

US 2002/0023761 A1 Feb. 28, 2002

(30) Foreign Application Priority Data

Sep. 15, 1997 (FI) ..... 973695
Dec. 9, 1997 (FI) ..... 974465

(51) Int. Cl.[7] ..... A62C 35/00
(52) U.S. Cl. ..... 169/9; 169/16; 169/61
(58) Field of Search ..... 169/60, 61, 64, 169/9, 16

(56) References Cited

U.S. PATENT DOCUMENTS 3,012,613 A * 12/1961 Diquattro ..... 239/9
3,464,172 A * 9/1969 McGee, Jr. ..... 239/16
3,613,794 A * 10/1971 Naumann ..... 169/28
3,708,194 A * 1/1973 Amit ..... 293/1
3,827,502 A * 8/1974 Lockwood ..... 169/9
4,082,148 A * 4/1978 Willms ..... 169/61
4,520,871 A * 6/1985 Miller et al. ..... 239/9
5,713,417 A * 2/1998 Sundholm ..... 169/9
5,909,776 A * 6/1999 Stewart et al. ..... 169/26
5,909,777 A * 6/1999 Jamison ..... 169/64

FOREIGN PATENT DOCUMENTS

| | | |
|---|---|---|
| JP | 52 156 300 | 11/1977 |
| JP | 61 134500 | 6/1986 |
| JP | 9 206 402 | 8/1997 |
| WO | 9222353 | 12/1992 |
| WO | 9310860 | 6/1993 |

* cited by examiner

*Primary Examiner*—Christopher Kim
(74) *Attorney, Agent, or Firm*—Ladas & Parry LLP

(57) ABSTRACT

A fire fighting apparatus has releaseable spray heads, a tube system for leading extinguishing medium from an extinguishing medium source to the spray heads, and at least one drive gas source for driving the extinguishing medium at a high pressure via the tube system to the spray heads. The at least one drive gas source is coupled to a long tube constituting part of the tube system in such a way that the long tube together with the at least one drive gas source constitutes an hydraulic accumulator. The volume of the extinguishing medium source is constituted by the volume of the long tube at least to a substantial extent.

14 Claims, 2 Drawing Sheets

FIRE FIGHTING APPARATUS

BACKGROUND OF THE INVENTION

The invention relates to a fire fighting apparatus comprising a plurality of spray heads, a tube system for leading extinguishing medium from an extinguishing medium source having a volume for extinguishing medium to the spray heads, at least one drive gas source for driving extinguishing medium at a high pressure via the tube system to the spray heads and release means for activating at least one of the spray heads. Such fire fighting apparatuses are known e.g. from the International Patent Application with the publication number WO 92/22353.

Prior art fire fighting apparatuses comprise one container or a number of containers for extinguishing medium, the containers being positioned adjacent to each other and arranged to deliver extinguishing medium via a tube system to spray heads or sprinklers. The length and shape of the tube system depend on the application and the operating principle. Fire fighting apparatuses for bigger spaces, such as hotels, ships and industrial buildings, often have long tube systems.

The source of extinguishing medium of the fire fighting apparatuses in said applications can be e.g. the water mains, or a water container, from which water is pumped to the spray heads. Alternatively, the source of extinguishing medium can be a water bottle, to which is coupled a pressure gas bottle capable of driving the water (or another extinguishing medium) out of the bottle to the spray heads. Such a combination constitutes a hydraulic accumulator.

Long tunnels are technically particularly difficult spaces to extinguish a fire in. The tunnels can have a length of several kilometres—even some ten kilometres—and a diameter of e.g. 3 metres. The tunnels often contain cables. A cable fire may cause great damage. Extinction of a fire in such long tunnels is assumed to be so difficult to arrange that, in most cases, the tunnels do not contain any fire fighting system at all. In case if the length of the tunnel is some kilometres and the intention is to lead extinguishing liquid, such as water, into the tunnel via a tube from one end thereof to a distance of some kilometres from said tunnel end, a drive pressure so high is required that, on account of pressure losses in the tube, it cannot be generated, in practice.

BRIEF DESCRIPTION OF THE INVENTION

The object of the present invention is to simplify the construction of such fire fighting apparatuses that are used for extinguishing fires in different major spaces and buildings and that are especially well suitable for use in long tunnels and the like. For this purpose, the invention is characterized in that said at least one drive gas source is coupled to a long tube constituting part of the tube system in such a way that the tube together with said at least one drive gas source constitutes a hydraulic accumulator and the volume of the source of extinguishing medium is constituted by the volume of the tube at least to a substantial extent. A long tube means in this connection primarily a tube having a length of the size of about 1 km and more.

An especially preferred embodiment of the invention is characterized in that a plurality of drive gas sources are arranged at a predetermined distance from each other along the tube. This embodiment suits particularly well for fighting fires in tunnels, the tube being in such applications a substantially straight tube. Here, the tube system has been built into the tunnel in the longitudinal direction thereof and the tube is preferably divided into a number of main sections, each one containing a drive gas source. The main sections are preferably divided into a number of zones, each one containing a group of spray heads or sprinklers. One group or several groups of spray heads or sprinklers are released at fire, when required.

An essential feature of the invention is to utilize the tube as a source of extinguishing medium for a hydraulic accumulator. Another essential feature is to position a number of drive gas sources along the tube, whereby the pressure losses can be kept on an acceptable level, and to use the tube as the source of extinguishing medium. This is possible, because the tube is long and may contain a relatively big volume of extinguishing medium. No separate liquid containers are needed for extinguishing liquid, when the tube is used as the source of extinguishing medium. The consumption of extinguishing medium will be small, when the spray heads used are of a type producing mist-like spray. Such a spray head is presented e.g. in the International Patent Application with the publication number WO 92/22353.

Thanks to the invention, a fire fighting apparatus has been provided which has a simple structure and installation and which is not dependent on outer drive sources, such as electricity and pumps, and which, in addition, suits especially well for extinguishing fires in long tunnels. There is no need of separate sources of extinguishing medium, such as liquid bottles, and these can be omitted. The fire fighting apparatus is environment friendly when the extinguishing medium is water-based liquid.

BRIEF DESCRIPTION OF THE DRAWING

In the following, the invention will be described by means of two embodiments with reference to the attached drawing, in which.

DETAILED DESCRIPTION OF THE INVENTION

Figure 1:
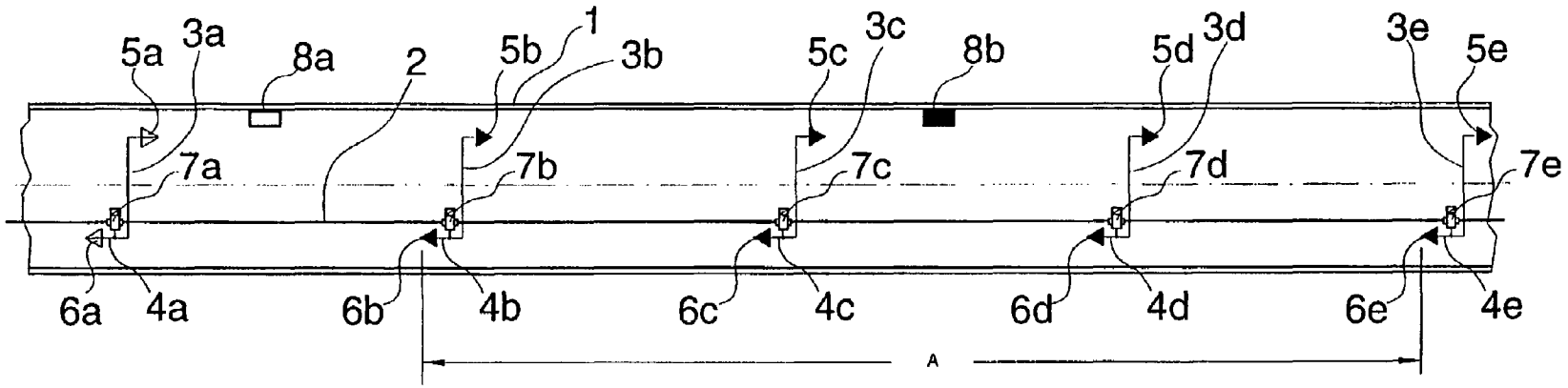
FIG. 1 shows a tunnel containing a fire fighting apparatus according to the invention.

FIG. 1 illustrates a tunnel 1 for cables, in which tunnel is mounted a fire fighting apparatus according to the invention. The tunnel is e.g. 10 km long. A tube system is positioned in the tunnel 1 extending from one end thereof to the other end, the system comprising a long tube 2, from which extend shorter tubes 3*a* to 3*e* and 4*a* to 4*e* leading to spray heads or sprinklers 5*a* to 5*e* and 6*a* to 6*e*, respectively. The spray heads may be of the type presented in the International Patent Application with the publication number WO 92/22353 and having a k factor of 1,9. The spray heads have at least two, but typically a plurality of nozzles, which are arranged geometrically in relation to each other in such a way and have such an opening and such a scattering angle that they produce a penetrating mist-like spray at high drive pressure. The consumption of extinguishing liquid is small in spite of that a long throw is achieved. The drive pressure is e.g. 70 bar.

The length of the tube 2 is divided into a number of zones A, each of them having a length of 22.5 m. In FIG. 1, a zone A has eight spray heads, i.e. the spray heads 5*b* to 5*e* and 6*b* to 6*e*, the distance between the spray heads adjacent to each other being 7.5 m. The eight spray heads form a group of spray heads arranged to be released simultaneously in case of fire within the zone A. The upper spray heads 5*b* to 5*e* in the group are arranged to spray to the right along the tunnel 1, while the lower spray heads 6*b* to 6*e* are arranged to spray in the opposite direction. Because the spray heads 5*b* to 5*e* are arranged one after the other in FIG. 1, the sprays intensify each other. This is also true of the spray heads 6*b* to 6*e*. In the vicinity of each spray head, a suction is built up by the spray head itself when spraying, said suction taking in the extinguishing medium that is sprayed out of the spray head positioned behind: for example, the suction at the spray head 5*c* takes in the extinguishing medium coming from the spray head 5*b*. The suction at the spray head 6*e* is capable of taking in part of the extinguishing medium coming from the spray head 5*d*, and the suction at the spray head 5*b* is capable of taking in part of the extinguishing medium coming from the spray head 6*c*, though these spray heads are directed in the opposite direction. In this way, a circulation of mist-like extinguishing medium is provided upon activating the spray heads, which medium extinguishes the fire effectively. Reference numerals 7*a* to 7*e* indicate solenoid valves, or another type of valves, to make the spray heads be released in the group desired. Accordingly, the solenoid valve 7*a* controls the spray heads 5*a* and 6*a*; and the solenoid valves 7*b* to 7*e* control the spray heads 5*b* to 5*e* and 6*b* to 6*e*. FIG. 1 shows a situation in which the spray heads 5*b* to 5*e* and 6*b* to 6*e* have been released, while the spray heads 5*a* and 6*a* in the adjacent zone have not been released. The maximum number of spray heads being released at a fire may e.g. be 8+4+4, the spray heads existing in three adjacent zones A. At fire extinction, a demand for a 10 min extinction by means of four spray heads may be 47 I gas at a pressure of 150 bar together with 150 I water or water-based liquid. In case if the maximum number of spray heads, i.e. 16, are released during a time of 30 min, 3×4×150 I=1800 I water is required. At the beginning of the spraying, the maximum pressure in the spray heads is kept at about 100 bar.

The reference numerals 8*a* and 8*b* indicate fire detector devices. These can be smoke detectors, detectors sensitive to heat or, in principle, any detectors giving a signal to the solenoid valves 7*a* to 7*e*. The fire detector 8*a* gives a signal to the solenoid valve 7*a* and opens this, while the fire detector 8*b* gives a signal to the solenoid valves 7*b* to 7*e* and opens these.

Figure 2:
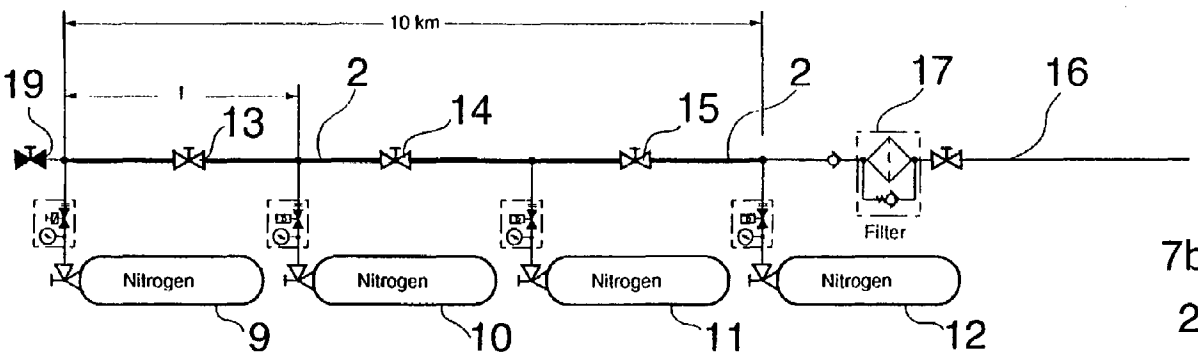
FIG. 2 illustrates a drive source of the fire fighting apparatus.

FIG. 2 shows that the tube 2 comprises nitrogen bottles 9 to 12 and stop/opening valves 13 to 15 arranged in such a way that there always is one nitrogen bottle and one stop valve at the distance of 1 km. The nitrogen bottles 9 to 12, which together with the tube 2 form hydraulic accumulators, provide the extinguishing medium in the tube with a high pressure. The volume of the nitrogen bottles 9 to 12 is 50 litres and the pressure is 250 bar. The pressure loss in the tube 2 will be 133 bar at the maximum for the parameters stated. The loading pressure may preferably be within the pressure range of 30 to 400 bar, preferably 100 to 300 bar, depending on the length of the tunnel.

When the tube 2 is 10 km long and has an outer diameter of 25 mm and a wall thickness of 2.5 mm, the content of the tube will be about 3000 litres. Accordingly, the tube 2 contains about 3000 litres of water or water-based liquid, when the installation is in a standby state and the apparatus is ready to be released.

To begin with, the water in the tube 2 is obtained from a water mains 16 at a pressure higher than 3 bar. Reference numeral 17 indicates a filter and reference numeral 19 a valve enabling a tilling of the tube 2. The valve 19 is open when the filling of the tube 2 with water is started. After the tube has been filled, the valve 19 is closed.

Figure 3:
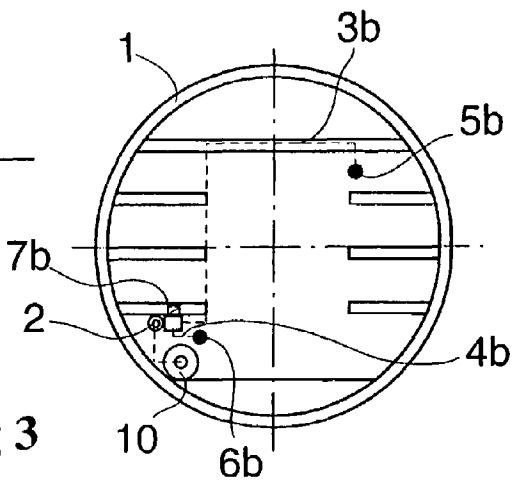
FIG. 3 shows a cross-section of the tunnel of FIG. 1.
Figure 4:
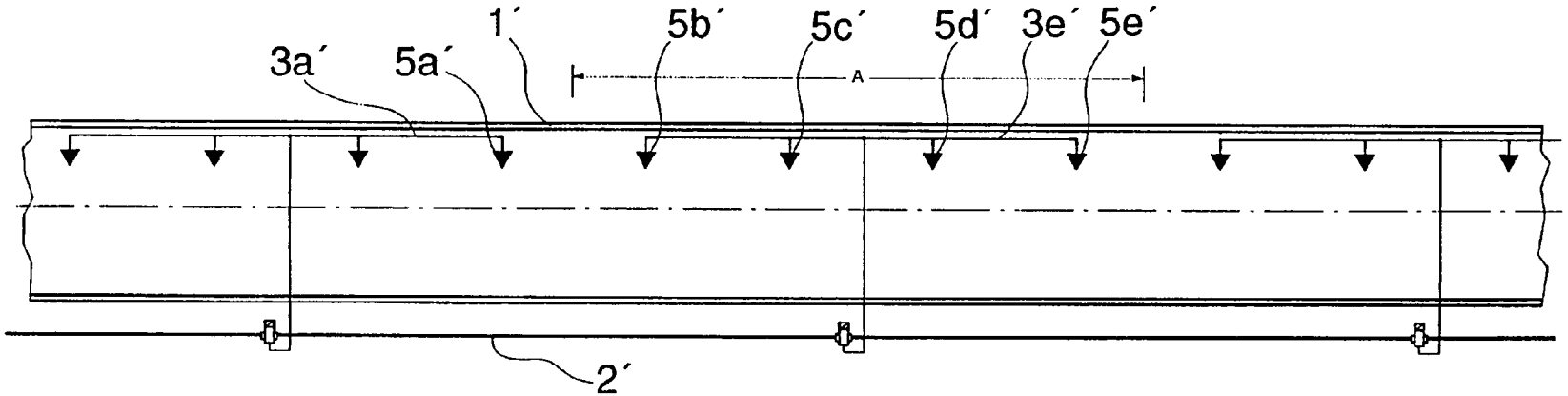
FIG. 4 shows a tunnel containing another embodiment of the fire fighting apparatus of the invention.
Figure 6:
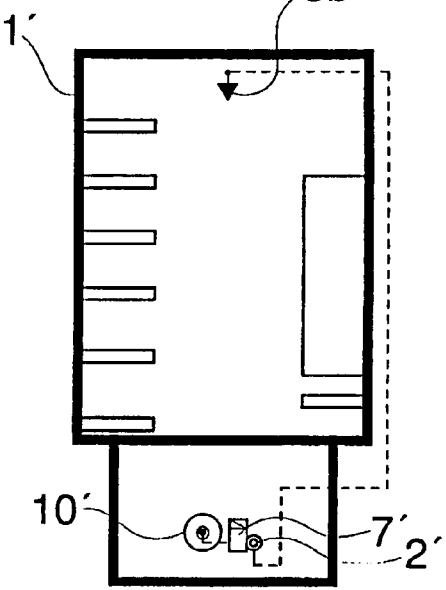
FIG. 6 shows a cross-section of the tunnel of FIG. 4.
Figure 5:
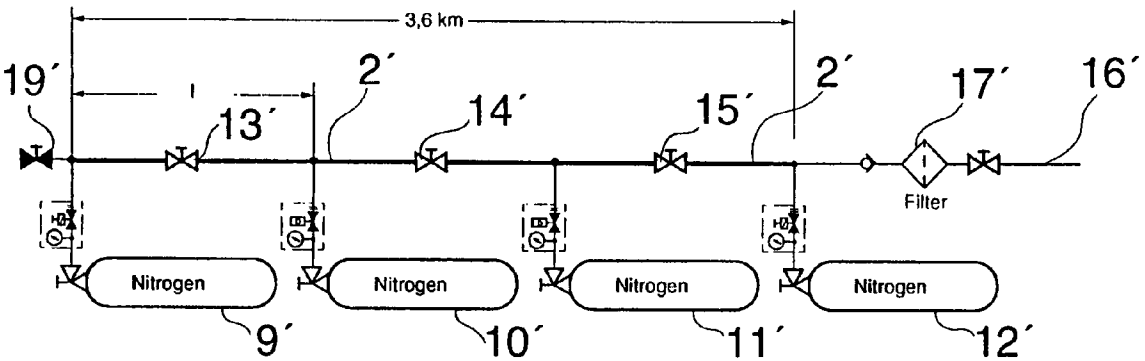
FIG. 5 shows the drive source for the fire fighting apparatus of FIG. 4.

FIGS. 4 to 6 show another embodiment of the invention. Reference numerals used in the FIGS. 4 to 6 correspond to those used in the FIGS. 1 to 3 for the respective parts, an apostrophe being an extra addition. The embodiment of FIGS. 4 to 6 differs from the embodiment of FIGS. 1 to 3 therein that spray heads 5*b*' to 5*e*' in a group of spray heads or sprinklers to be released simultaneously are directed (orientated) differently. In the embodiment of FIG. 4, a circulation of a mist of extinguishing medium is not provided, but all spray heads 5*a*', 5*b*' to 5*e*' spray downwards. It is conceivable that spray heads (not shown) are arranged downwards in the tunnel 1' to spray in the direction towards the spray heads 5*e*', 5*b*' to 5*e*' to provide a circulation of extinguishing medium, as described above. Another difference is that the tube 2' is arranged in a separate channel outside the tunnel 1'. A further difference is that only one solenoid valve 7' controls a whole group of spray heads 5*b*' to 5*e*' or sprinklers. From FIG. 6 appears that the cross-section of the tunnel 1' is rectangular and from FIG. 5 appears that the length of the tunnel is 3.6 km. No fire detector is drawn in FIG. 4, though it may exist, as described in connection with FIG. 1. In case if 5*b*' to 5*e*' indicate sprinklers, i.e. spray heads with an ampoule being released by heat, the release of the group of sprinklers can be arranged to occur with any sprinkler of the group, whereby this releases the other sprinklers belonging to the group, preferably as described in the International Patent Application with the publication number WO 93/10860.

The invention is described above by means of one embodiment only, and therefore, it is pointed out that the details of the invention can be implemented in many ways within the scope of the attached claims. Accordingly, the length of the tube 2 may vary from the described one. In the application of the invention for extinguishing a fire in a tunnel, the tube length referred to is of the size of at least about 1 km and typically several kilometres, though a tube length of only some hundred metres can be actual in certain applications. It is conceivable that sprinklers, i.e. spray heads with separate release means, such as ampoules bursting at increased temperature, are possible instead of spray heads receiving a signal from a detector. Hereby, it is a sprinkler of a group of sprinklers in a zone (A) which makes the other sprinklers belonging to the zone be released. The fire fighting apparatus may comprise both sprinklers and spray heads, e.g. in such a way that a sprinkler is arranged in each zone (A) to release the spray heads existing in said zone. The length of the zones may vary as may the number of spray heads/sprinklers in the zones. Instead of nitrogen, the content of the gas bottles can be carbon dioxide, argon or another gas suitable for the purpose or a gas mixture at high pressure. The fire fighting apparatus may be installed in major spaces other than a tunnel, as was mentioned earlier.

What is claimed is:

1. A fire fighting apparatus comprising a plurality of spray heads (5*a* to 5*e*, 6*a* to 6*e*; 5*a*', 5*b*' to 5*e*'), a tube system (2, 3*a* to 3*e*, 4*a* to 4*e*; 2', 3*a*', 3*e*') for leading extinguishing medium to the spray heads, a first drive gas source (9; 9') for driving the extinguishing medium at a high pressure via the tube system to the spray heads and release means (8*a*, 8*b*) for activating at least one of the spray heads, wherein:

the first drive gas source (9; 9') is coupled to an extinguishing medium source consisting essentially of a long tube (2; 2') constituting part of the tube system.

2. A fire fighting apparatus according to claim 1, characterized in that a plurality of second drive gas sources (10 to 12; 10' to 12') are arranged to the tube (2; 2') at predetermined distances (1) from the first gas drive sources (9; 9') along the tube (2; 2').

3. A fire fighting apparatus according to claim 2, characterized in that a stop/opening valve (13 to 15; 13' to 15') for closing and opening the flow of extinguishing medium in the tube (2; 2) is arranged between individual drive gas sources (9 to 12; 9' to 12').

4. A fire fighting apparatus according to claim 2, characterized in that the tube (2; 2') is divided into a number of main sections (1), each containing at least one of the second drive gas sources.

5. A fire fighting apparatus according to claim 4, characterized in that the drive gas sources are constituted by nitrogen bottles (9; 9') having a pressure of 30 to 400 bar.

6. A fire fighting apparatus according to claim 4, characterized in that the main sections (1) comprise a number of zones (A), each of them containing a group of the spray heads (5*b* to 5*e*, 6*b*, 6*e*'; 5*b*' to 5*e*').

7. A fire fighting apparatus according to claim 6, characterized in that the release means (8*a*, 8*b*) are arranged along the tube (2;2') within the zones (A) for releasing a group of the spray heads (5*b* to 5*e*, 6*b* to 6*e*); 5*b*' to 5*e*') belonging respectively to the zones.

8. A fire fighting apparatus according to claim 7, characterized in that each group of spray heads (5*b* to 5*e*, 6*b* to 6*e*; 5*b*' to 6*e*') contains a valve (7*b* to 7*e*; 7') to control at least one spray head belonging to the group (5*b* to 5*e*, 6*b* to 6*e*; 5*b*' to 5*e*').

9. A fire fighting apparatus according to claim 1, characterized in that the tube system (2, 3*a* to 3*e*, 4*a* to 4*e*; 2', 3*a*', 3*e*') follows a longitudinal direction of a tunnel (1; 1').

10. A fire fighting apparatus according to claim 9, characterized in that the spray heads comprise first spray heads (5*b* to 5*e*) arranged in an upper part of the tunnel (1) and second spray heads (6*b* to 6*e*) arranged in a lower part of the tunnel, whereby the first spray heads are arranged to spray mainly in the opposite direction with respect to the second spray heads.

11. A fire fighting apparatus according to claim 1, characterized in that the spray heads (5*a* to 5*e*, 6*b* to 6*e*; 5*a*' to 5*e*') spray mist.

12. a fire fighting apparatus according to claim 1, characterized in that the extinguishing medium is water-based liquid.

13. A fire fighting apparatus comprising a plurality of spray heads (5*a* to 5*e*, 6*a* to 6*e*; 5*a*', 5*b*' to 5*e*'), a tube system (2, 3*a* to 3*e*, 4*a* to 4*e*; 2', 3*a*', 3*e*') for leading extinguishing medium to the spray heads, at least one drive gas source (9 to 12; 9' to 12') for driving the extinguishing medium at a high pressure via the tube system to the spray heads and release means (8*a*, 8*b*) for activating at least one of the spray heads, wherein the at least one drive gas source (9 to 12; 9' to 12') is coupled to an extinguishing medium source which consists essentially of a long tube (2; 2') which has a length of at least two hundred meters and constitutes part of the tube system.

14. A fire fighting apparatus comprising a plurality of spray heads (5*a* to 5*e*, 6*a* to 6*e*; 5*a*', 5*b*' to 5*e*'), a tube system (2, 3*a* to 3*e*, 4*a* to 4*e*; 2', 3*a*', 3*e*') for leading extinguishing medium to the spray heads, at least one drive gas source (9 to 12; 9' to 12') for driving the extinguishing medium at a high pressure via the tube system to the spray heads and release means (8*a*, 8*b*) for activating at least one of the spray heads, wherein the at least one drive gas source (9 to 12; 9' to 12') is coupled to an extinguishing medium source which consists essentially of a long tube (2; 2') which has a length of at least about 1 km and constitutes part of the tube system.

* * * * *